US011407563B2

(12) United States Patent
Tollefsen et al.

(10) Patent No.: US 11,407,563 B2
(45) Date of Patent: Aug. 9, 2022

(54) DEVICES AND SYSTEMS FOR DISPENSING MATERIAL

(71) Applicant: The Gorilla Glue Company LLC, Cincinnati, OH (US)

(72) Inventors: Trond Erik Tollefsen, London (GB); Ryan Joseph Boudreaux, Yorktown Heights, NY (US); Nicholas John Wagner, Plano, IL (US); Mitchell James Wagner, Sugar Grove, IL (US); Ryan David Mahoney, Cincinnati, OH (US); Kevin Jay Gampfer, Milford, OH (US); Jeremy Thomas Lacy, Centerville, OH (US)

(73) Assignee: The Gorilla Glue Company LLC, Cincinnati, OH (US)

( * ) Notice: Subject to any disclaimer, the term of this patent is extended or adjusted under 35 U.S.C. 154(b) by 0 days.

(21) Appl. No.: 17/103,196

(22) Filed: Nov. 24, 2020

(65) Prior Publication Data

US 2021/0155380 A1 May 27, 2021

Related U.S. Application Data

(60) Provisional application No. 62/941,316, filed on Nov. 27, 2019.

(51) Int. Cl.
*B65D 35/28* (2006.01)

(52) U.S. Cl.
CPC ..... *B65D 35/28* (2013.01)

(58) Field of Classification Search
CPC ..... B65D 35/28
(Continued)

(56) References Cited

U.S. PATENT DOCUMENTS 1,306,830 A * 6/1919 Moore ..... B43K 7/02 401/143
1,320,275 A * 10/1919 Roach ..... B65D 35/28 222/103

(Continued)

FOREIGN PATENT DOCUMENTS

CN 203186657 U 9/2013
EP 0579906 B1 4/1993

(Continued)

OTHER PUBLICATIONS

Extended European Search Report dated Apr. 28, 2020, relating to European Patent Application No. 19215430.3.

*Primary Examiner* — Paul R Durand
*Assistant Examiner* — Michael J. Melaragno
(74) *Attorney, Agent, or Firm* — Dinsmore & Shohl LLP

(57) ABSTRACT

A device for dispensing a material having: a first surface with an orifice; a second surface opposite the first surface; a first endface comprising an annular opening; a second endface opposite the first endface; a cavity defined by the above. An actuator is anchored to the second surface and has at least a portion of a pressing pad extending through the orifice in the first surface. An inner side of the second surface comprises a contoured portion within the cavity, the contoured portion having a first end positioned toward the second endface and a second end positioned toward the first endface, wherein the contoured portion has a maximum height at or near the first end, and a minimum height at a position between the first end and the second end.

20 Claims, 6 Drawing Sheets

(58) Field of Classification Search
USPC ..... 222/103
See application file for complete search history.

(56) References Cited

U.S. PATENT DOCUMENTS 1,760,945 A * 6/1930 Grigsby ..... B65D 35/28 222/105
2,053,697 A * 9/1936 Cassanos ..... B65D 35/28 222/103
D116,240 S 8/1939 Petzold
D123,502 S 11/1940 Jung
2,515,440 A * 7/1950 Cicero ..... B65D 35/28 222/103
2,537,008 A * 1/1951 Abbott ..... B65D 35/28 222/96
2,643,029 A * 6/1953 Chapman ..... B65D 35/28 222/103
2,674,392 A * 4/1954 Kunz ..... B65D 35/28 222/80
2,678,755 A * 5/1954 Buras, Jr. ..... B65D 35/28 222/103
2,759,636 A * 8/1956 Albert ..... B65D 35/28 222/103
2,763,401 A * 9/1956 Buras, Jr. ..... B65D 35/28 222/103
2,781,951 A * 2/1957 Hanford ..... A61D 1/02 222/103
D195,649 S 7/1963 Lindemann
3,155,278 A * 11/1964 Le Baron ..... A47K 1/09 222/93
3,217,930 A * 11/1965 Battaglini ..... B65D 35/285 222/93
3,221,940 A * 12/1965 Watson, Jr. ..... B65D 35/285 222/96
3,252,624 A * 5/1966 Watson, Jr. ..... B65D 35/285 222/96
D205,316 S 7/1966 Armour
3,291,345 A * 12/1966 Mccombs ..... B65D 35/28 222/103
3,405,843 A * 10/1968 Watson, Jr. ..... B05B 11/3001 222/95
3,450,309 A * 6/1969 Di Millo ..... B65D 35/28 222/103
3,675,822 A * 7/1972 Casali ..... B65D 35/28 222/103
3,768,699 A * 10/1973 Robe, Jr. ..... B65D 35/28 222/103
3,938,898 A 2/1976 Reitknecht
3,961,727 A * 6/1976 Spears ..... B65D 35/28 222/103
4,019,656 A * 4/1977 Spears ..... B65D 35/28 222/103
D248,865 S 8/1978 Sussman et al.
4,172,536 A * 10/1979 Holt ..... B65D 35/28 222/103
4,326,647 A * 4/1982 Pool ..... B65D 35/28 222/103
4,565,303 A * 1/1986 Gilbertson ..... A47K 5/18 222/103
4,748,990 A 6/1988 Brown et al.
D300,265 S 3/1989 Brown et al.
4,880,409 A * 11/1989 Bergkvist ..... A01K 9/005 604/73
D309,716 S 8/1990 Umekawa
5,105,984 A * 4/1992 Kazimir ..... A47K 5/122 222/103
5,145,093 A * 9/1992 Zeller ..... B65D 35/28 222/103
D338,159 S 8/1993 Densky et al.
5,322,194 A * 6/1994 Roberts ..... B65D 35/28 222/103
5,323,932 A 6/1994 Bauman
D362,623 S 9/1995 Ma
5,501,370 A 3/1996 Okamura et al.
5,505,342 A 4/1996 Okamura et al.
5,743,434 A * 4/1998 Light ..... B65D 35/28 222/103
5,782,385 A * 7/1998 Soon ..... B65D 35/28 222/103
5,810,205 A * 9/1998 Kohen ..... B65D 35/28 222/103
D421,058 S 2/2000 Regan et al.
6,234,353 B1 * 5/2001 Light ..... B65D 35/28 222/103
6,315,165 B1 11/2001 Regan
6,669,055 B1 * 12/2003 Coleman ..... B65D 35/28 222/103
6,695,174 B2 * 2/2004 Sørensen ..... A47K 5/1211 222/183
D496,279 S 9/2004 Hama et al.
D497,107 S 10/2004 Hama et al.
6,968,978 B1 * 11/2005 Matthews ..... B65D 35/28 222/103
D537,730 S 3/2007 Shimizu et al.
D555,012 S 11/2007 Yamauchi et al.
D557,340 S 12/2007 Nagahama et al.
8,056,748 B2 11/2011 Chen
8,714,407 B2 5/2014 Frank et al.
8,757,438 B1 * 6/2014 Garcia ..... B65D 35/28 222/94
9,309,028 B2 4/2016 Kealy et al.
9,669,652 B2 6/2017 Kobayashi et al.
2007/0218229 A1 9/2007 Nagahama et al.
2017/0267413 A1 9/2017 Qian

FOREIGN PATENT DOCUMENTS

EP 0521200 A2 7/1993
EP 0639510 A2 7/1994
EP 1091884 B1 6/1999
EP 2490956 B1 8/2014
EP 2576373 A4 12/2014
JP 2003020078 A 1/2003
JP 2003226374 A 8/2003
JP 2004182249 A 7/2004
JP 5212579 B1 6/2013
WO 2007113244 A1 10/2007
WO 2013118582 A1 8/2013
WO WO-2015012842 A1 * 1/2015 ..... A47K 1/09
WO 2016090811 A1 6/2016
WO 2017178487 A1 10/2017

* cited by examiner

DEVICES AND SYSTEMS FOR DISPENSING MATERIAL

CROSS REFERENCE TO RELATED APPLICATION

This application claims benefit of U.S. Provisional Patent Application Ser. No. 62/941,316 filed on Nov. 27, 2019, which is hereby incorporated by reference in its entirety.

BACKGROUND

The present specification generally relates to devices and systems for dispensing material and, more specifically related to devices and systems for controlled dispensing of an adhesive from a tube.

Deformable tubes (for example, aluminum tubes) are often used for containing and dispensing materials, such as viscous liquids and gels, including, for example, adhesives. It can be difficult, however, to regulate the flow of materials out of deformable tubes. Dispensing material from them can be imprecise and messy, resulting in wasted material. In addition, the user may not squeeze the tube in the correct area, resulting in some of the material remaining trapped in the tube.

Various dispensing devices have been developed to provide a controlled delivery of materials, such as viscous liquids and gels, from deformable tubes. Typically, these devices comprise a container or casing surrounding the tube with buttons or jaws on the container or casing, which are manipulated to press against the deformable tube to dispense the viscous material. Often, however, these devices include multiple parts that are relatively expensive and complicated to manufacture and/or assemble. Additionally, in many instances, the devices are not capable of dispensing all or even most of the contents of the tubes, resulting in wasted material that the consumer cannot utilize.

Accordingly, the need still exists in this art for a device that dispenses a precise amount of a material, such as a viscous liquid or gel material, to a surface.

SUMMARY

In a first aspect a device for dispensing a material comprises: a first surface comprising an orifice; a second surface opposite the first surface; a first endface comprising an annular opening; a second endface opposite the first endface; a cavity defined by the first surface, the second surface, the first endface, and the second endface; and an actuator anchored to the second surface and comprising a pressing pad, wherein at least a portion of the pressing pad extends through the orifice in the first surface, wherein the second surface comprises an outer side that faces outward from the device and an inner side that faces inward to the cavity, and the inner side of the second surface comprises a contoured portion within the cavity, the contoured portion having a first end positioned toward the second endface and a second end positioned toward the first endface, wherein the contoured portion has a maximum height at or near the first end, and a minimum height at a position between the first end and the second end.

A second aspect comprises the device of the first aspect, wherein, wherein the second surface is a rigid surface without any orifices.

A third aspect comprises the device of the first or second aspect, wherein the contoured portion is contoured to match a shape of a tube of material.

A fourth aspect comprises the device of any of the first to third aspects, wherein the contoured portion is positioned within the cavity so that when a tube of liquid material is placed in the cavity, a reservoir of the tube is positioned between the second end of the contoured portion and the annular opening of the first endface.

A fifth aspect comprises the device of any of the first to fourth aspects, wherein a distance between the annular opening in the first endface and the second end of the contoured portion is from 55% to 75% of the diameter of the annular opening.

A sixth aspect comprises the device of any of the first to fifth aspects, wherein a distance between the annular opening in the first endface and the second end of the contoured portion is from 0.310 inches to 0.380 inches.

A seventh aspect comprises the device of any of the first to sixth aspects, wherein an end of the orifice closest to the first endface is aligned across the cavity from the second end of the contoured portion.

An eighth aspect comprises the device of any of the first to seventh aspects, wherein the actuator comprises a planar contact surface opposite the pressing pad and an angled surface adjacent to the planar contact surface, the angled surface being positioned toward the first endface of the device from the planar contact surface.

A ninth aspect comprises the device of the eighth aspect, wherein an angle $\theta$ is present between the planar contact surface and the angled surface.

A tenth aspect comprises the device of the ninth aspect, wherein the angle $\theta$ is from 160° to 170°.

An eleventh aspect comprises the device of the tenth aspect, wherein, when pressure is applied to the pressing pad of the actuator, the intersection of the planar contact surface and the angled surface is opposite the second end of the contoured portion.

A twelfth aspect comprises the device of the eleventh aspect, wherein when pressure is applied to the pressing pad of the actuator, a distance between the annular opening in the first endface and the intersection of the planar contact surface and the angled surface is from 55% to 75% of the diameter of the annular opening.

A thirteenth aspect comprises the device of the eleventh, wherein when pressure is applied to the pressing pad of the actuator, a distance between the annular opening in the first endface and the intersection of the planar contact surface and the angled surface is from 0.310 inches to 0.380 inches.

A fourteenth aspect includes a system for dispensing a material from a tube comprising: a first surface comprising an orifice; a second surface opposite the first surface; a first endface comprising an annular opening; a second endface opposite the first endface; a cavity defined by the first surface, the second surface, the first endface, and the second endface; a tube containing the material positioned within the cavity; a nozzle detachably attached to the tube and protruding from the cavity through the annular opening in the first endface; an actuator anchored to the second surface and comprising a pressing pad, wherein at least a portion of the pressing pad extends through the orifice in the first surface, wherein the second surface comprises an outer side that faces outward from the device and an inner side that faces inward to the cavity, and the inner side of the second surface comprises a contoured portion within the cavity, the contoured portion having a shape that replicates the shape of the tube of material.

A fifteenth aspect comprises a system of the fourteenth aspect, wherein the tube of material comprises a shoulder, and the shoulder is positioned between the second end of the contoured portion and the annular opening of the first endface.

A sixteenth aspect comprises a system of the fifteenth aspect, wherein the actuator comprises a planar contact surface opposite the pressing pad and an angled surface adjacent to the planar contact surface, the angled surface being positioned toward the shoulder of the tube containing the material.

A seventeenth aspect comprises a system of the sixteenth aspect, wherein applying pressure to the pressing pad of the actuator causes the planar contact surface to move toward the tube containing the material, thereby dispensing material through the nozzle.

An eighteenth aspect comprises a system of any one of the fifteenth or sixteenth aspects, wherein a distance between the annular opening in the first endface and the second end of the contoured portion is from 55% to 75% of the diameter of the shoulder.

A nineteenth aspect comprises a system of any one of the sixteenth to eighteenth aspects, wherein when material is fully dispensed from the tube, a reservoir is present in the tube, the reservoir is positioned between the second end of the contoured portion and the annular opening of the first endface.

A twentieth aspect comprises the system of the nineteenth aspect, wherein when material is fully dispensed from the tube and pressure is applied to the pressing pad of the actuator, the reservoir is positioned between an intersection of the planar contact surface and the angled surface of the actuator and annular opening of the first endface.

Additional features and advantages will be set forth in the detailed description that follows, and in part will be readily apparent to those skilled in the art from that description or recognized by practicing the embodiments described herein, including the detailed description that follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
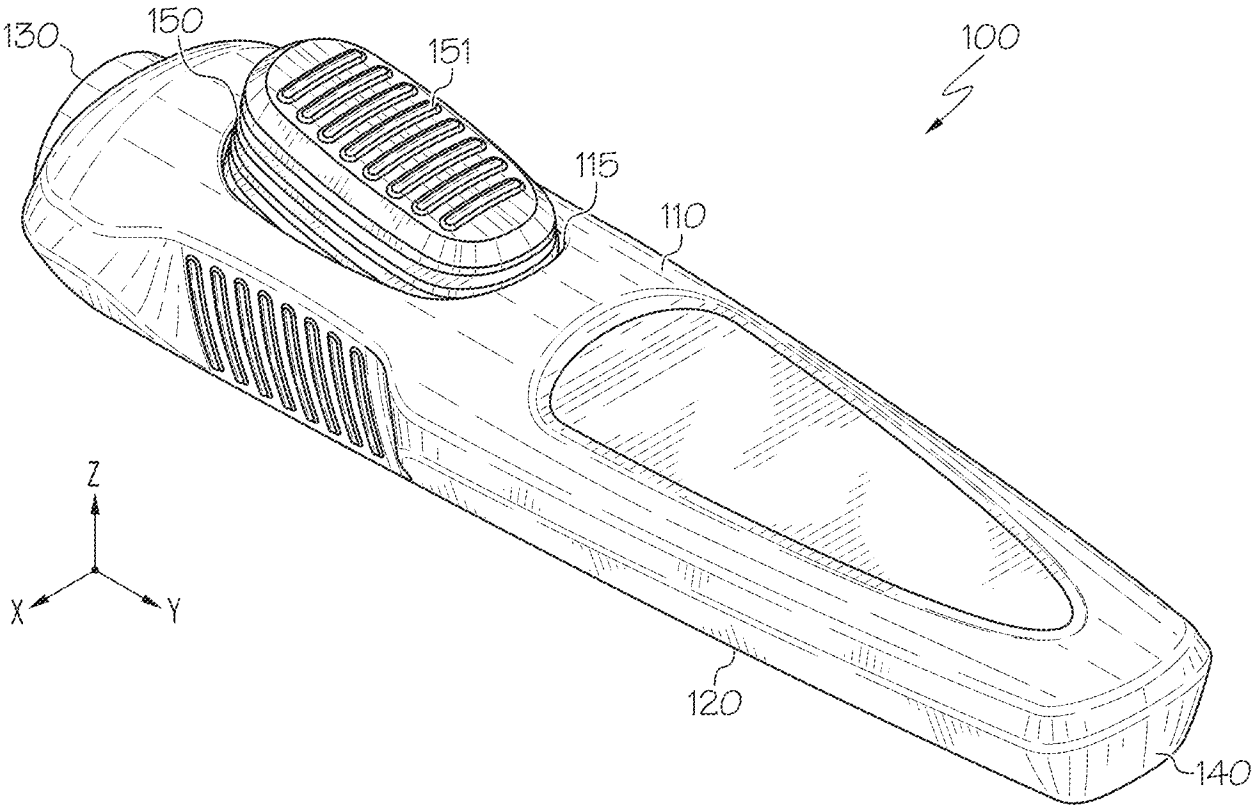
FIG. 1 is an isometric view of a device for dispensing a material according to embodiments disclosed and described herein.

Reference will now be made in detail to embodiments of devices and systems for dispensing a material, embodiments of which are illustrated in the accompanying drawings. Whenever possible, the same reference numerals will be used throughout the drawings to refer to the same or like parts. In embodiments, a device for dispensing a material comprises: a first surface comprising an orifice; a second surface opposite the first surface; a first endface comprising an annular opening; a second endface opposite the first endface; a cavity defined by the first surface, the second surface, the first endface, and the second endface; and an actuator anchored to the second surface and comprising a pressing pad, wherein at least a portion of the pressing pad extends through the orifice in the first surface, wherein the second surface comprises an outer side that faces outward from the device and an inner side that faces inward to the cavity, and the inner side of the second surface comprises a contoured portion within the cavity, the contoured portion having a first end positioned toward the second endface and a second end positioned toward the first endface, wherein the contoured portion has a maximum height at or near the first end, and a minimum height at a position between the first end and the second end.

Figure 4:
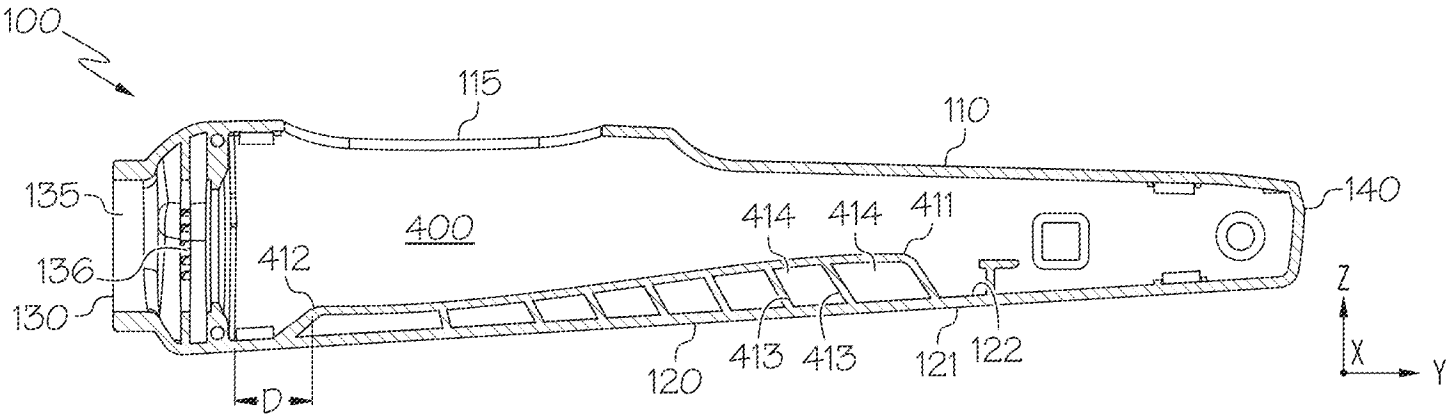
FIG. 4 is a cross-section view of a device for dispensing a material according to embodiments disclosed and described herein.

Referring now to FIG. 1, a device for dispensing a material 100 according to embodiments is depicted and comprises a first surface 110 having an orifice 115. A portion of a pressing pad 151 of an actuator 150 extends through the orifice 115 in the first surface 110. The device for dispensing a material 100 also comprises a second surface 120 that is opposite the first surface 110 in the z-direction, a first endface 130, and a second endface 140 that is opposite the first endface 130 in the y-direction. It should be understood that, according to embodiments, the device for dispensing a material 100 may be manufactured in one or more pieces and assembled to form the device for dispensing a material 100. For instance, the device for dispensing a material 100 may be divided along a line of radial symmetry (i.e., along the y-axis) into a right side component (such as shown in FIG. 4), a left side component that is symmetrical to the right side component, and the actuator. The right side component, the left side component, and the actuator may be combined to form the device for dispensing a material 100. Molding and manufacturing the device for dispensing a material 100 may be simplified by dividing the device for dispensing a material 100 into multiple components and then assembling the components together.

Figure 2:
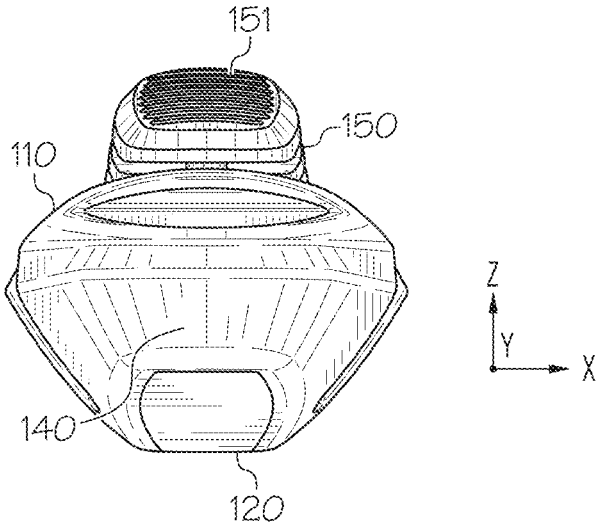
FIG. 2 is a rear view of a device for dispensing a material according to embodiments disclosed and described herein.

With reference now to FIG. 1 and FIG. 2, the second endface 140 will be described in more detail. The second endface 140 is positioned opposite the first endface 130 of the device for dispensing a material 100 in the y-direction.

In embodiments, the second endface 140 is a closed endface, which, as used herein, means that the second endface 140 does not include any openings that allow access to the inside of the device for dispensing a material 100. In the embodiments shown in FIG. 2 and FIG. 1, the second endface 140 has an arcuate shape in the y-direction. However, in embodiments that are not shown in FIG. 1 and FIG. 2, the second endface 140 may have an essentially planar shape that allows the device for dispensing a material 100 to rest upright with the first endface 140 acting as a base of the device for dispensing a material 100. The second endface 140 is positioned further from the orifice 115 in the first surface 110 than the first endface 130, such that when the device for dispensing a material 100 is in use, the second endface 140 is positioned toward the user and the first endface 130 is positioned away from the user.

Figure 3:
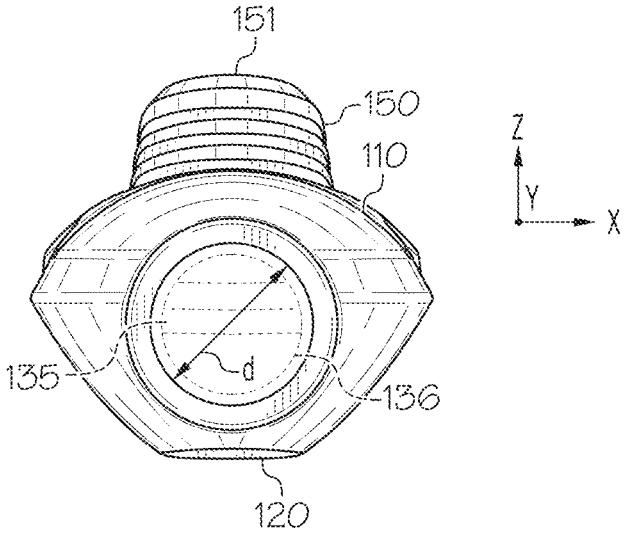
FIG. 3 is a front view of a device for dispensing a material according to embodiments disclosed and described herein.

With reference now to FIG. 1 and FIG. 3, the first endface 130 will be described in more detail. The first endface 130 is position proximate to the orifice 115 in the first surface 110 of the device for dispensing a material 100, such that the first endface 130 is positioned away from the user when the device for dispensing a material 100 is in use. In embodiments, the first endface 130 comprises an annular opening 135. The annular opening 135 of the first endface 130 has a diameter d. In embodiments the diameter d of the annular opening 135 in the first endface 130 is approximately equal to the diameter of nozzle base of a tube of material to be dispensed (not shown in FIG. 1 or FIG. 3), such as a tube containing viscous liquids or gels. In embodiments, a circumferential shelf 136 is positioned within the annular opening 135, and the nozzle base is positioned against the circumferential shelf 136 such that the nozzle base is locked into place within the annular opening 135 by the circumferential shelf. In embodiments, the circumferential shelf 136 comprises teeth that mate with teeth present on the nozzle base to lock the nozzle base into place within the annular opening.

With reference now to FIG. 4, a cross-section view of the device for dispensing a material 100 will be described. FIG. 4 shows a cavity 400 that is defined by the first surface 110, the second surface 120, the first endface 130, and the second endface 140. The cavity 400 is the interior of the device for dispensing a material 100 and is configured to hold a tube of dispensing material, such as viscous liquid or gel, including adhesives. As shown in FIG. 4, the second surface 120 comprises an outer side 121 that faces outward from the device for dispensing a material 100 and an inner side 122 that faces inward into the cavity 400. The inner side 122 of the second surface 120 comprises a contoured portion 410 that is positioned within the cavity 400 and extends in the y-direction. The contoured portion 410 has a first end 411 positioned toward the second endface 140 and a second end 412 positioned toward the first endface 130. The contoured portion 410 has a maximum height at or near the first end 411 and a minimum height at a position between the first end 411 of the contoured portion 410 and the second end 412 of the contoured portion 410. The height of the contoured portion 410 is defined in the z-direction. This shape of the contoured portion 410 is configured to match the shape of a tube of dispensing material, such as a viscous liquid or gel, including a liquid adhesive. In addition, by having a minimum height of the contoured portion 410 positioned between the first end 411 of the contoured portion 410 and the second end 412 of the contoured portion 410, the contoured portion 410 provides a trough around the minimum height of the contoured portion. As shown in FIG. 4, the contoured portion 410 may, according to embodiments, be formed from a plurality of support structures 413 and comprising gaps 414 between adjacent support structures 413. This construction allows the contoured portion 410 to have the required rigidity while at the same time providing a lightweight design that also decreases material costs. However, it should be understood that the contour portion 410 could, in embodiments, be made from a single piece of material that is molded to match the shape of the contoured portion 410.

According to embodiments, there is a distance present between the annular opening 135 in the first endface 130 and the second end 412 of the contoured portion 410. This distance is measured from the inner most portion of the annular opening 135 (i.e., the portion of the annular opening 135 furthest into the cavity 400 in the z-direction) and the second end 412 of the contoured portion 410. This distance is shown as D in FIG. 4.

According to embodiments, the distance D present between the annular opening 135 in the first endface 130 and the second end 412 of the contoured portion 410 is measured in relation to the diameter of the annular opening 135 in the first endface 130 of the device for dispensing a material 100. In embodiments, the distance D present between the annular opening 135 in the first endface 130 and the second end 412 of the contoured portion 410 is from 55% to 75% of the diameter of the annular opening 135 in the first endface 130 of the device for dispensing a material 100, such as from 57% to 75% of the diameter of the annular opening 135 in the first endface 130 of the device for dispensing a material 100, from 60% to 75% of the diameter of the annular opening 135 in the first endface 130 of the device for dispensing a material 100, from 62% to 75% of the diameter of the annular opening 135 in the first endface 130 of the device for dispensing a material 100, from 65% to 75% of the diameter of the annular opening 135 in the first endface 130 of the device for dispensing a material 100, from 67% to 75% of the diameter of the annular opening 135 in the first endface 130 of the device for dispensing a material 100, from 70% to 75% of the diameter of the annular opening 135 in the first endface 130 of the device for dispensing a material 100, or from 72% to 75% of the diameter of the annular opening 135 in the first endface 130 of the device for dispensing a material 100. In embodiments, the distance D present between the annular opening 135 in the first endface 130 and the second end 412 of the contoured portion 410 is from 55% to 72% of the diameter of the annular opening 135 in the first endface 130 of the device for dispensing a material 100, such as from 55% to 70% of the diameter of the annular opening 135 in the first endface 130 of the device for dispensing a material 100, from 55% to 67% of the diameter of the annular opening 135 in the first endface 130 of the device for dispensing a material 100, from 55% to 65% of the diameter of the annular opening 135 in the first endface 130 of the device for dispensing a material 100, from 55% to 62% of the diameter of the annular opening 135 in the first endface 130 of the device for dispensing a material 100, from 55% to 60% of the diameter of the annular opening 135 in the first endface 130 of the device for dispensing a material 100, or from 55% to 57% of the diameter of the annular opening 135 in the first endface 130 of the device for dispensing a material 100. In embodiments, the distance D present between the annular opening 135 in the first endface 130 and the second end 412 of the contoured portion 410 is from 57% to 72% of the diameter of the annular opening 135 in the first endface 130 of the device for dispensing a material 100, such as from 60% to 70% of the diameter of the annular opening 135 in the first endface 130 of the device for dispensing a material 100, or from 62% to 67% of the diameter of the annular opening 135 in the first endface 130 of the device for dispensing a material 100.

In embodiments, the distance D present between the annular opening 135 in the first endface 130 and the second end 412 of the contoured portion 410 is from 0.310 inches to 0.380 inches, such as from 0.320 inches to 0.380 inches, from 0.330 inches to 0.380 inches, from 0.340 inches to 0.380 inches, from 0.350 inches to 0.380 inches, from 0.360 inches to 0.380 inches, or from 0.370 inches to 0.380 inches. In embodiments, the distance D present between the annular opening 135 in the first endface 130 and the second end 412 of the contoured portion 410 is from 0.310 inches to 0.370 inches, such as from 0.310 inches to 0.360 inches, from 0.310 inches to 0.350 inches, from 0.310 inches to 0.340 inches, from 0.310 inches to 0.330 inches, or from 0.310 inches to 0.320 inches. In embodiments, the distance D present between the annular opening 135 in the first endface 130 and the second end 412 of the contoured portion 410 is from 0.320 inches to 0.370 inches, such as from 0.330 inches to 0.360 inches, or from 0.340 inches to 0.350 inches.

According to embodiments, and as shown in FIG. 4, there is a predetermined relationship between the orifice 115 in the first surface 110 and the contoured portion 410. For instance, in embodiments, the end of the orifice 115 closest to the first endface 130 of the device for dispensing a material 100 is positioned across the cavity 400 from the second end 412 of the contoured portion 410. This relationship between the orifice 115 in the first surface 110 and the contoured portion 410 allows the actuator (shown in FIG. 5 and FIG. 6) to be positioned in the correct position relative to the contoured portion 410. Namely, because a portion of the pressing pad 151 (shown in FIG. 1 and FIG. 5) extends through the orifice 115 in the first surface 110 the device for dispensing a material 100, the positioning of the orifice 115 will, in part, dictate the positioning of the actuator within the device for dispensing a material 100.

Figure 5:
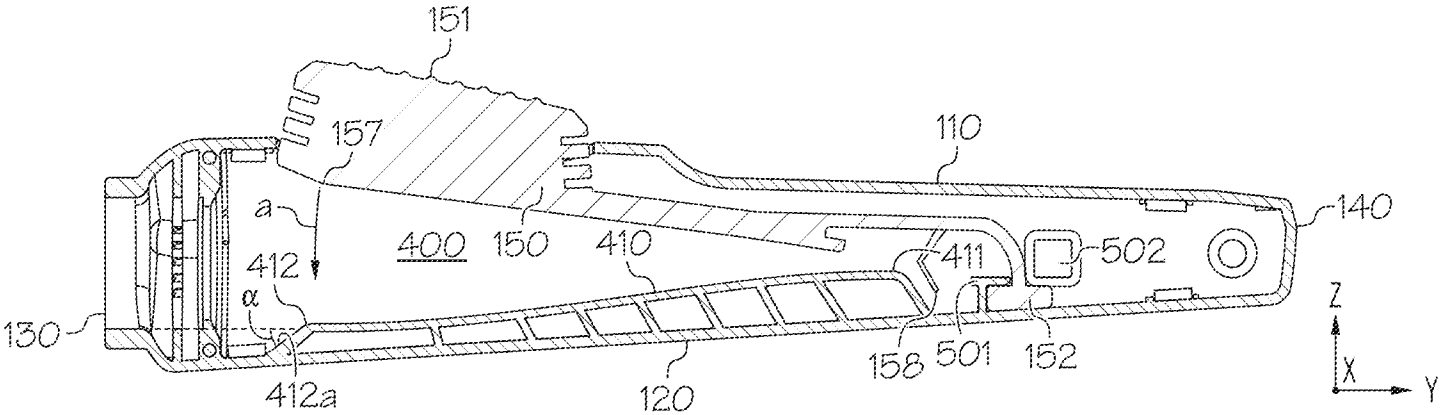
FIG. 5 is a cross-section view of a device for dispensing a material with an actuator engaged according to embodiments disclosed and described herein.
Figure 6:
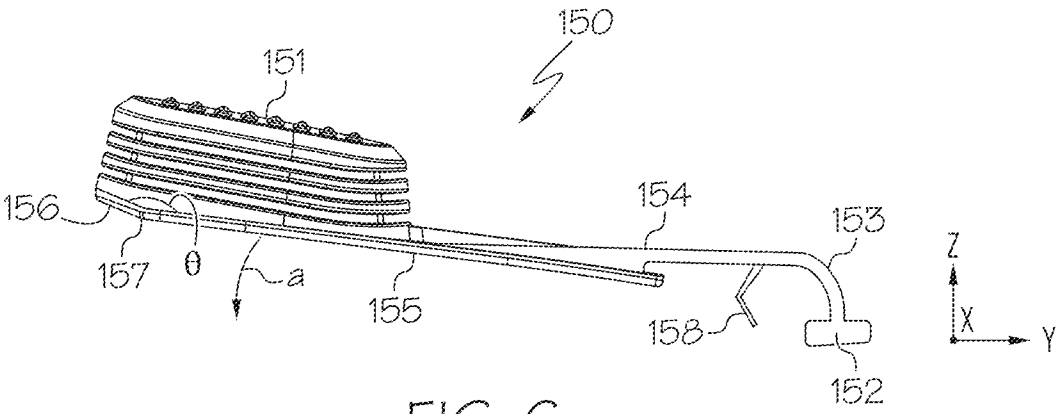
FIG. 6 is a side view of an actuator according to embodiments disclosed and described herein.

The actuator 150 according to embodiments will now be described with reference to FIG. 5 and FIG. 6, where FIG. 5 is a cross-section view of the actuator 150 placed within the device for dispensing a material 100, and FIG. 6 is a side view of the actuator 150. The actuator 150 comprises an anchor 152 that anchors the actuator 150 to the second surface 120 of the device for dispensing a material 100. In the embodiment depicted in FIG. 5, the anchor 152 of the actuator 150 is physically anchored to the second surface 120 of the device for dispensing a material 100 by placing the anchor 152 between a first support pin 501 formed in the inner side 122 of the second surface and second support pin 502 that extends in the x-direction. As shown in FIG. 5, the first support pin 501 and the second support pin 502 are positioned to accept the anchor 152 of the actuator 150 and hold the anchor 152 of the actuator 150 in place. It should be understood that the mechanism for anchoring the actuator 150 to the second surface 120 of the device for dispensing a material 100 is not particularly limited, and multiple mechanisms could be used.

Opposite the anchor 152 of the actuator 150 in the y-direction is the pressing pad 151 of the actuator 150. The pressing pad 151 of the actuator 150 is configured so that a finger, such as an index figure, or a thumb of a user can rest on the pressing pad 151 of the actuator 150. When pressure is applied to the pressing pad 151 of the actuator 150, such as by a user's finger or thumb, the actuator moves in the direction of arrow a into the cavity 400 of the device for dispensing a material 100. Accordingly, when a tube of material to be dispensed—such as a viscous liquid or gel, including an adhesive—is present in the cavity 400 of the device for dispensing a material 100, applying pressure to the pressing pad 151 of the actuator 150 causes the actuator to move in the direction of arrow a and into the tube of material to be dispensed, thus dispensing the material to be dispensed from the tube, as will be described in more detail below. A portion of the pressing pad 151 extends through the orifice 115 in the first surface 110 so that a user can easily access and apply pressure to the pressing pad 151.

The actuator 150 also comprises an arced portion 153 that extends from the anchor 152 to an arm 154 of the actuator 150. The arm 154 of the actuator, in turn, extends from the arced portion 153 to the pressing pad 151 of the actuator 150. This arced portion 153 of the actuator 150 allows the actuator 150 to fit into the cavity 400 of the device for dispensing a material 100. Further, the arced portion 153 of the actuator 150 provides the actuator 150 with an elastic effect such that when pressure is applied by a user to the pressing pad 151, the actuator moves in the direction of the arrow a into the cavity 400, but when the pressure is removed, the actuator 150 returns to its original position. Accordingly, the actuator is, in embodiments, made from materials that provide this elastic effect. In embodiments, the second surface 120 of the device for dispensing a material 100 is a rigid surface that allows the actuator to have this elastic effect. And, in some embodiments, the second surface 120 does not include any orifices.

The actuator 150 further comprises a planar contact surface 155 that is positioned opposite to a portion of the pressing pad 151. When a tube of material to be dispensed is present in the cavity 400 of the device for dispensing a material 100, the planar contact surface 155 of the actuator 150 is configured as the portion of the actuator that contacts a majority of the tube of material to be dispensed. The actuator also comprises an angled surface 156 adjacent to the planar contact surface 155 and positioned toward the first endface 130 of the device for dispensing a material 100 relative to the planar contact surface 155. Thus, an intersection 157 between the angled surface 156 and the planar surface 155 is present. In this way, the angled surface 156 of the actuator is positioned toward the shoulder of a tube of material to be dispensed relative to the planar contact surface 155 when such a tube of material to be dispensed is present in the cavity 400 of the device for dispensing a material 100.

An angle θ is present between the planar contact surface 155 and the angled surface 156. In embodiments, the angle θ is from 160° to 170°, such as from 161° to 170°, from 162° to 170°, from 163° to 170°, from 164° to 170°, from 165° to 170°, from 166° to 170°, from 167° to 170°, from 168° to 170°, or from 169° to 170°. In embodiments, the angle θ is from 160° to 169°, such as from 160° to 168°, from 160° to 167°, from 160° to 166°, from 160° to 165°, from 160° to 164°, from 160° to 163°, from 160° to 162°, or from 160° to 161°. In embodiments, the angle θ is from 161° to 169°, such as from 162° to 168°, from 163° to 167°, or from 164° to 166°. The angle θ is configured such that when a tube of material to be dispensed is present in the cavity 400 of the device for dispensing a material 100 and pressure is applied to the pressing pad 151 by a user such that the actuator 150 is fully depressed, the angled surface 156 provides room for a reservoir to be formed in the tube of material to be dispensed.

Figure 7:
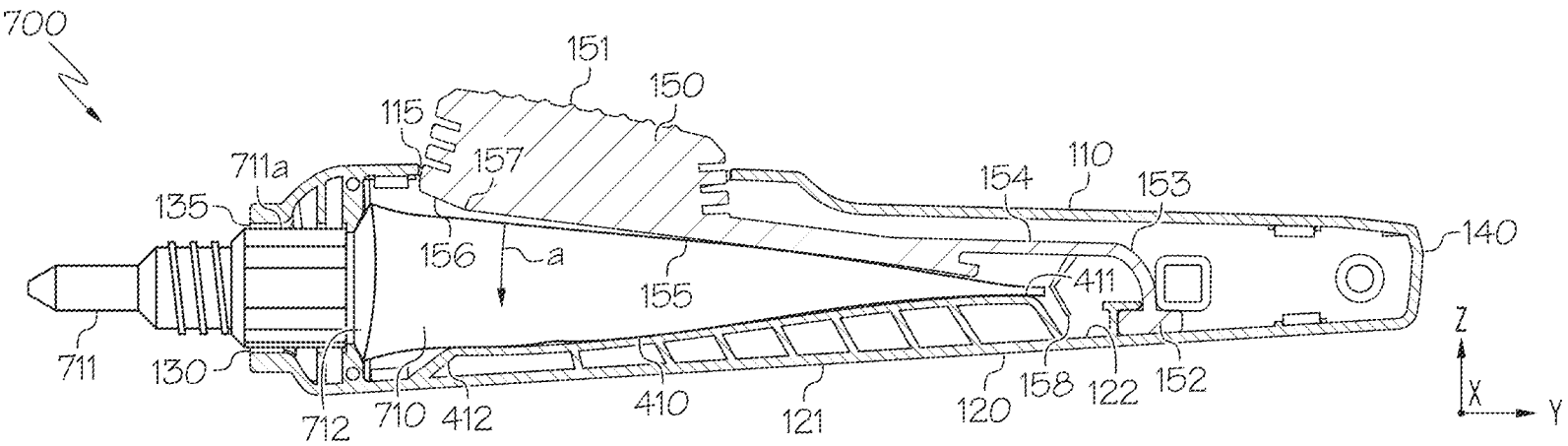
FIG. 7 is a cross-section view of system for dispensing material from a tube according to embodiments disclosed and described herein.

According to embodiments, a backstop 158 is positioned on the actuator 150 between the anchor 152 and the planar contact surface 155. The backstop 158 extends from the underside of arm 154 of the actuator 150 and extends in the same direction as the anchor 152 in the z-direction. According to embodiments, and as depicted in FIG. 6, the backstop 158 has a first portion that is slanted away from the anchor 152 and toward the planar contact surface 155 in the y-direction, and the backstop 158 has a second portion that is slanted toward the anchor 152 and away from the planar contact surface 155 in the y-direction. As shown in FIG. 7, the backstop 158 is positioned to prevent a tube that is positioned within the device for dispensing a material 100 from moving away from the annular opening 135 of the device for dispensing a material 100 in the y-direction. The angle at which the first portion of the backstop 158 and the second portion of the backstop 158 are situated relative to one another and relative to the arm 154 of the actuator 150 are not particularly limited and may be any angle sufficient to prevent a tube that is positioned within the device for dispensing a material 100 from moving away from the annular opening 135 of the device for dispensing a material 100 in the y-direction and fit within the device for dispensing a material 100.

Figure 9:
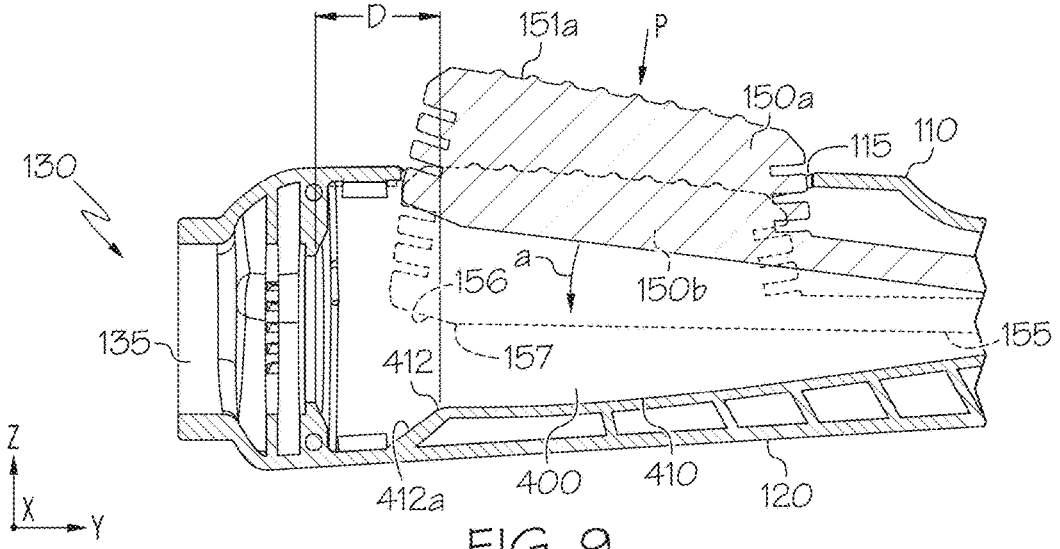
FIG. 9 is a cross-section view of a device according to embodiments disclosed and described herein before and after pressure has been applied to a pressing pad.

With reference now to FIG. 9, the device for dispensing a material 100 will be described with the actuator in its initial position 150*a* (i.e., when no pressure is applied to the pressing pad 151*a*) and when pressure P has been applied to the pressing pad 151*b* and the actuator 150*b* is positioned within the cavity 400 of the device for dispensing a material 100. As shown in FIG. 9, when no pressure is applied to the pressing pad 151*a* of the actuator 150*a*, at least a portion of the pressing pad 151*a* extends through the orifice 115 in the first surface 110 of the device for dispensing a material 100 and is readily available for a user to apply pressure to the pressing pad 151*a*. In this position, there is a maximum distance between the planar contact surface 155 of the actuator 150*a* and the contoured portion 410 of the second surface 120 of the device for dispensing a material 100. In this position, the cavity 400 is approximately the size of a tube of material to be dispensed when the tube of material to be dispensed is full. When a user applies pressure P to the pressing pad 151*a*, the actuator 150*a* moves into the cavity 400 in the direction of arrow a and will be situated at the positioned indicated by actuator 150*b* and pressing pad 151*b* as shown in FIG. 9. In this position, if a tube of material to be dispensed were present in the cavity 400 of the device for dispensing a material 100, the tube of material to be depressed will be essentially evacuated of material, such as a viscous liquid or gel, including an adhesive. In this position, the is a minimum distance between the planar contact surface 155 of the actuator 150*b* and the contoured portion 410 of the second surface 120 of the device for dispensing a material 100.

As shown in FIG. 9, when pressure P is applied to the pressing pad 151*b* of the actuator 150*b*, the intersection 157 of the planar contact surface 155 and the angled surface 156 is opposite the second end 412 of the contoured portion 410. By this positioning, the angled surface 156 of the actuator 150*b* and a sloped edge 412*a* of the second end 412 of the contoured portion 410 create an angle that allows a reservoir, which will be provided in more detail below, to be formed in the tube of material to be dispensed. The sloped edge 412*a* slopes away from the contoured portion 410 at an angle $\alpha$ from 15° to 50°, such as from 15° to 45°, from 15° to 40°, from 15° to 35°, from 15° to 30°, from 20° to 45°, from 20° to 40°, from 20° to 35°, from 20° to 30°, from 25° to 35°, or about 30°.

According to embodiments, when pressure is applied to the pressing pad 151, the distance D present between the annular opening 135 in the first endface 130 and the intersection 157 of the planar contact surface 155 and the angled surface 156 is measured in relation to the diameter of the annular opening 135 in the first endface 130 of the device for dispensing a material 100. In embodiments, when pressure is applied to the pressing pad 151, the distance D present between the annular opening 135 in the first endface 130 and the intersection 157 of the planar contact surface 155 and the angled surface 156 is from 55% to 75% of the diameter of the annular opening 135 in the first endface 130 of the device for dispensing a material 100, such as from 57% to 75% of the diameter of the annular opening 135 in the first endface 130 of the device for dispensing a material 100, from 60% to 75% of the diameter of the annular opening 135 in the first endface 130 of the device for dispensing a material 100, from 62% to 75% of the diameter of the annular opening 135 in the first endface 130 of the device for dispensing a material 100, from 65% to 75% of the diameter of the annular opening 135 in the first endface 130 of the device for dispensing a material 100, from 67% to 75% of the diameter of the annular opening 135 in the first endface 130 of the device for dispensing a material 100, from 70% to 75% of the diameter of the annular opening 135 in the first endface 130 of the device for dispensing a material 100, or from 72% to 75% of the diameter of the annular opening 135 in the first endface 130 of the device for dispensing a material 100. In embodiments, when pressure is applied to the pressing pad 151, the distance D present between the annular opening 135 in the first endface 130 and the intersection 157 of the planar contact surface 155 and the angled surface 156 is from 55% to 72% of the diameter of the annular opening 135 in the first endface 130 of the device for dispensing a material 100, such as from 55% to 70% of the diameter of the annular opening 135 in the first endface 130 of the device for dispensing a material 100, from 55% to 67% of the diameter of the annular opening 135 in the first endface 130 of the device for dispensing a material 100, from 55% to 65% of the diameter of the annular opening 135 in the first endface 130 of the device for dispensing a material 100, from 55% to 62% of the diameter of the annular opening 135 in the first endface 130 of the device for dispensing a material 100, from 55% to 60% of the diameter of the annular opening 135 in the first endface 130 of the device for dispensing a material 100, or from 55% to 57% of the diameter of the annular opening 135 in the first endface 130 of the device for dispensing a material 100. In embodiments, when pressure is applied to the pressing pad 151, the distance D present between the annular opening 135 in the first endface 130 and the intersection 157 of the planar contact surface 155 and the angled surface 156 is from 57% to 72% of the diameter of the annular opening 135 in the first endface 130 of the device for dispensing a material 100, such as from 60% to 70% of the diameter of the annular opening 135 in the first endface 130 of the device for dispensing a material 100, or from 62% to 67% of the diameter of the annular opening 135 in the first endface 130 of the device for dispensing a material 100.

In embodiments, when pressure is applied to the pressing pad 151, the distance D present between the annular opening 135 in the first endface 130 and the intersection 157 of the planar contact surface 155 and the angled surface 156 is from 0.310 inches to 0.380 inches, such as from 0.320 inches to 0.380 inches, from 0.330 inches to 0.380 inches, from 0.340 inches to 0.380 inches, from 0.350 inches to 0.380 inches, from 0.360 inches to 0.380 inches, or from 0.370 inches to 0.380 inches. In embodiments, when pressure is applied to the pressing pad 151, the distance D present between the annular opening 135 in the first endface 130 and the intersection 157 of the planar contact surface 155 and the angled surface 156 is from 0.310 inches to 0.370 inches, such as from 0.310 inches to 0.360 inches, from 0.310 inches to 0.350 inches, from 0.310 inches to 0.340 inches, from 0.310 inches to 0.330 inches, or from 0.310 inches to 0.320 inches. In embodiments, when pressure is applied to the pressing pad 151, the distance D present between the annular opening 135 in the first endface 130 and the intersection 157 of the planar contact surface 155 and the angled surface 156 is from 0.320 inches to 0.370 inches, such as from 0.330 inches to 0.360 inches, or from 0.340 inches to 0.350 inches.

Systems for dispensing a material from a tube according to embodiments will now be provided with reference to FIG. 7. It should be understood that like-numbered components in the systems for dispensing a material from a tube 700 and the device for dispensing a material 100 described above have the same structure and will not be described in detail again. Systems for dispensing a material from a tube 700 according to embodiments includes a first surface 110 comprising an orifice 115, a second surface 120 opposite the first surface 110, a first endface 130 comprising an annular opening 135, and a second endface 140 opposite the first endface 130. In embodiments, the second endface 140 is a closed endface, which, as used herein, means that the second endface 140 does not include any openings that allow access to the inside of the device for dispensing a material 100. Systems for dispensing a material from a tube 700 include a cavity 400 defined by the first surface 110, the second surface 120, the first endface 130, and the second endface 140. A tube 710 containing the material to be dispensed is positioned within the cavity 400, the tube having a nozzle 711 that is detachably attached to the tube 710 containing the material to be dispensed. The nozzle 711 protrudes from the cavity 400 through the annular opening 135 in the first endface 130. Systems for dispensing a material from a tube 700 according to embodiments further comprise an actuator 150 as described hereinabove with reference to FIG. 5 and FIG. 6. The actuator 150 comprises a pressing pad 151, an anchor 152 that anchors the actuator 150 to the second surface 120 of the system for dispensing a material from a tube 700, an arced portion 153, an arm 154, a planar contact surface 155 opposite the pressing pad, an angled surface 156, and an intersection 157 of the angled surface 156 and the planar contact surface 155. In embodiments, at least a portion of the pressing pad 151 extends through the orifice 115 in the first surface 110.

Systems for dispensing a material from a tube 700 have a second surface 120 comprises an outer side 121 that faces outward from the system for dispending a material from a tube 700 and an inner side 122 that faces inward into the cavity 400. The inner side 122 of the second surface 120 comprises a contoured portion 410 that is positioned within the cavity 400 and extends in the y-direction. The contoured portion 410 has a first end 411 positioned toward the second endface 140 and a second end 412 positioned toward the first endface 130. The contoured portion 410 has a maximum height at or near the first end 411 and a minimum height at a position between the first end 411 of the contoured portion 410 and the second end 412 of the contoured portion 410. The height of the contoured portion 410 is defined in the z-direction. This shape of the contoured portion 410 is configured to match the shape of the tube 710. In addition, by having a minimum height of the contoured portion 410 positioned between the first end 411 of the contoured portion 410 and the second end 412 of the contoured portion 410, the contoured portion 410 provides a trough around the minimum height of the contoured portion.

The tube 710 of the system for dispending a material from a tube 700 comprises a shoulder 712 that is positioned between the second end of the contoured portion 410 and the annular opening 135 of the first endface 130. In one or more embodiments, the angled surface 156 of the actuator 150 is positioned toward the shoulder 712 of the tube 710 relative to the planar contact surface 155 of the actuator 150.

Figure 8A:
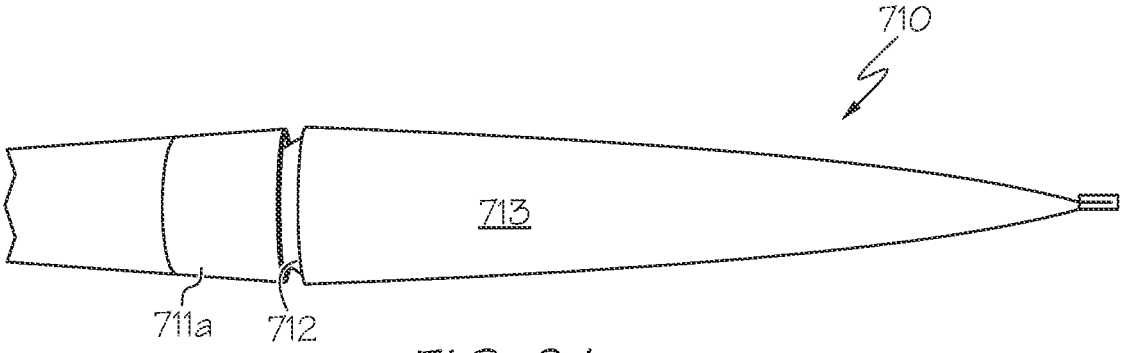
FIG. 8A is an image of a tube that is full of material to be dispensed.

The tube 710 of systems for dispending a material from a tube 700 will now be described in reference to FIG. 7, FIG. 8A, FIG. 8B, and FIG. 8C. A tube 710 that is full of material to be dispensed, such as viscous liquid or gel, including adhesives, is depicted in FIG. 8A. The tube comprises a deformable portion 713 that may, in embodiments, be made from aluminum or a polymer material. The deformable portion 713 contacts the contoured portion 410 and the planar contact surface 155 of the actuator 155 when the tube 710 is present in the system for dispending a material from a tube 700. The tube 710 also comprises a shoulder 712 that is, according to embodiments, made from a material, such as a metal that is more rigid than the deformable portion 713 of the tube 710. In addition, and in one or more embodiments, the nozzle 711 comprises a nozzle base 711*a* that locks into the annular opening 135 in the first endface 130. As discussed above, the nozzle base 711 may, in embodiments, comprise teeth that mate with teeth in the circumferential shelf in the annular opening 135 to lock the nozzle 711 into the annular opening 135.

Figure 8B:
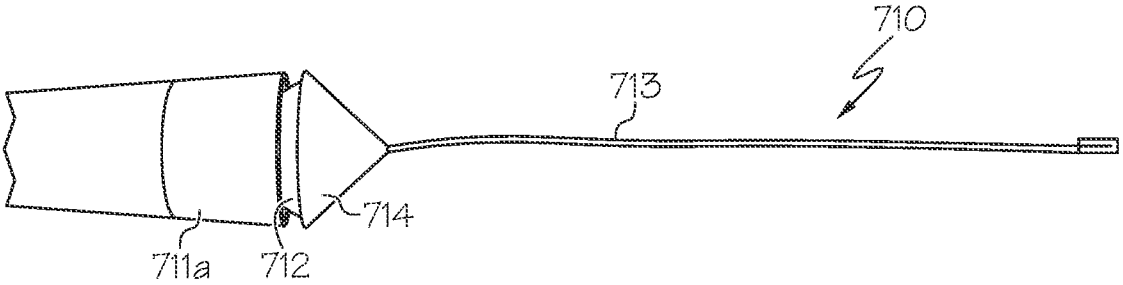
FIGS. 8B and 8C are images of a tube that has been evacuated of material to be dispensed.
Figure 8C:
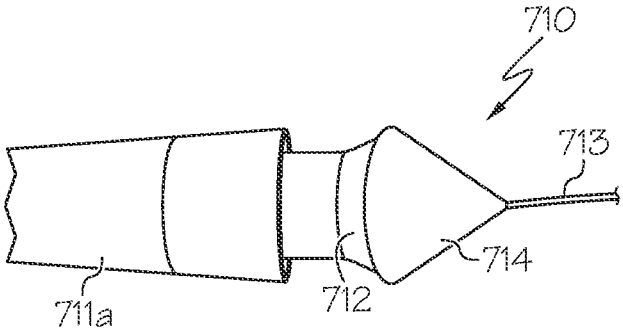

Before pressure is applied to the pressing pad 151 the tube 710 having a shape as shown in FIG. 8A is approximately the same shape as the cavity 400. When pressure is applied to the pressing pad 151 of the actuator 150 the pressure causes the actuator 150 to move into the cavity 400 in the direction of arrow a, which causes the material within the tube 710 to be dispensed. FIG. 8B and FIG. 8C both show a tube 710 where the material within the tube has been evacuated by this process. As can be seen in a comparison of FIG. 8A and FIG. 8B, the deformable portion 713 of the tube 710 has been significantly flattened in FIG. 8B compared to FIG. 8A. However, a reservoir 714 of material to be dispensed collects toward the shoulder 712 of the tube 710. This reservoir 714 is formed in part because the shoulder 712 of the tube 710 is formed from material that is more rigid than the deformable portion 713 of the tube 710. The reservoir 714 allows material to collect toward the nozzle 711 of the tube 710 before it is dispensed through the nozzle. Without being bound by any particular theory, the reservoir 714 in combination with the trough formed near the minimum height of the contoured portion 410—discussed above—provide a structure that allows material to backload into the tube 710 when pressure is disengaged from the pressing pad 151, which prevents material from seeping out of the nozzle 711 after pressure has been disengaged from the pressing pad. In addition, the reservoir 714 in combination with the trough formed near the minimum height of the contoured portion 410—discussed above—provide a structure that allows for more complete evacuation of the material from tube 710. As mentioned above, the reservoir 714 takes the shape that is formed by the angled surface 156 of the actuator 150 and the sloped edge of the second end 412 of the contoured portion 410.

According to embodiments, the distance D present between the annular opening 135 in the first endface 130 and the second end 412 of the contoured portion 410 is measured in relation to the diameter of the shoulder 712 of the tube 710. In embodiments, the distance D present between the annular opening 135 in the first endface 130 and the second end 412 of the contoured portion 410 is from 55% to 75% of the diameter of the shoulder 712 of the tube 710, such as from 57% to 75% of the diameter of the shoulder 712 of the tube 710, from 60% to 75% of the diameter of the shoulder 712 of the tube 710, from 62% to 75% of the diameter of the shoulder 712 of the tube 710, from 65% to 75% of the diameter of the shoulder 712 of the tube 710, from 67% to 75% of the diameter of the shoulder 712 of the tube 710, from 70% to 75% of the diameter of the shoulder 712 of the tube 710, or from 72% to 75% of the diameter of the shoulder 712 of the tube 710. In embodiments, the distance D present between the annular opening 135 in the first endface 130 and the second end 412 of the contoured portion 410 is from 55% to 72% of the diameter of the shoulder 712 of the tube 710, such as from 55% to 70% of the diameter of the shoulder 712 of the tube 710, from 55% to 67% of the diameter of the shoulder 712 of the tube 710, from 55% to 65% of the diameter of the shoulder 712 of the tube 710, from 55% to 62% of the diameter of the shoulder 712 of the tube 710, from 55% to 60% of the diameter of the shoulder 712 of the tube 710, or from 55% to 57% of the diameter of the shoulder 712 of the tube 710. In embodiments, the distance D present between the annular opening 135 in the first endface 130 and the second end 412 of the contoured portion 410 is from 57% to 72% of the diameter of the shoulder 712 of the tube 710, such as from 60% to 70% of the diameter of the shoulder 712 of the tube 710, or from 62% to 67% of the diameter of the shoulder 712 of the tube 710.

Figure 10:
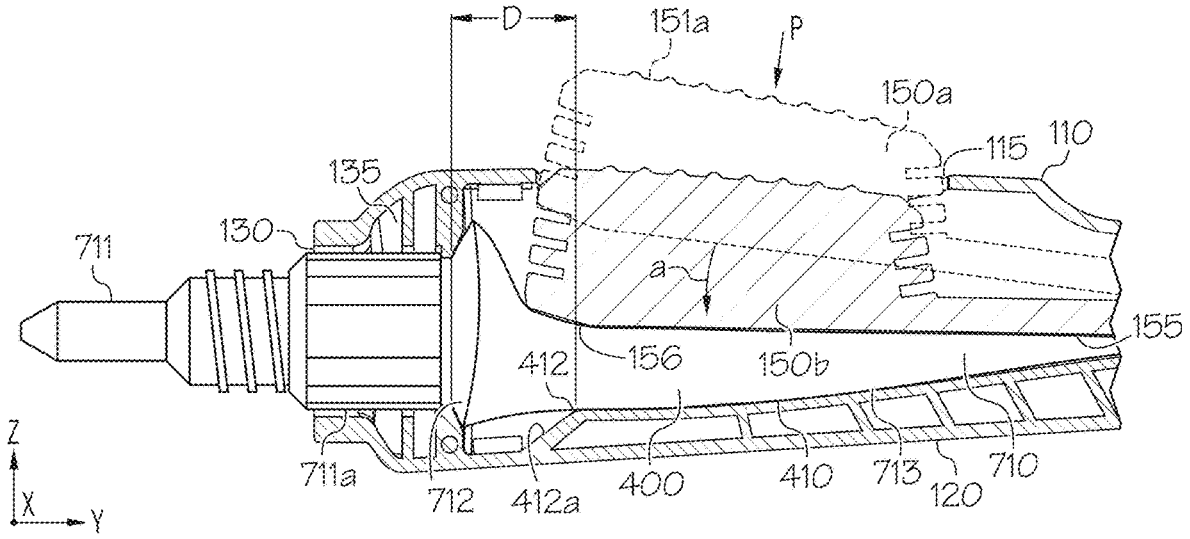
FIG. 10 is a cross-section view of a system including a tube of material according to embodiments disclosed and described herein before and after pressure has been applied to a pressing pad.

With reference now to FIG. 10, the system for dispensing a material 700 after pressure P has been applied to the pressing pad will be described in more detail. When a user applies pressure P to the pressing pad 151*a*, the actuator 150*a* moves into the cavity 400 in the direction of arrow a and will be situated at the positioned indicated by actuator 150*b* and pressing pad 151*b* as shown in FIG. 10. This causes the planar contact surface 155 to move toward the tube 710, such as the deformable portion of the tube 713, thereby causing material to be dispensed through the nozzle 711 of the tube. As shown in FIG. 10, when the material is fully dispensed from the tube 710, the reservoir 714 present in tube 710 is positioned between the second end 412 of the contoured portion 410 and the annular opening 135 of the first endface 130. Similarly, when the material is fully dispensed from the tube 710 and pressure is applied to the pressing pad 155 of the actuator 150, the reservoir 714 present in tube 710 is positioned between the intersection 157 of the planar contact surface 155 and the angled surface 156 of the actuator 150 and the annular opening 135 of the first endface 130. In this way, the device for dispensing a material (as shown in FIG. 5 for example) has a contoured portion 410 that is positioned within the cavity 400 so that when a tube 710 of material to be dispensed is placed into the cavity 400, a reservoir 714 of the tube 710 is positioned between the second end 412 of the contoured portion 410 and the annular opening 135 of the first endface 130.

EXAMPLES

Embodiments will be further clarified by the following example.

Tests were performed to compare the amounts and percentages of adhesive dispensed from tools made in accordance with the embodiments described above and illustrated in the accompanying drawings (identified in the Table as "Ex."). The tools were assembled with metal tubes containing approximately 6 gm of cyanoacrylate liquid adhesive obtained from Adhesive Systems, Inc., Frankfort, Ill. For comparison, 10 Loctite® Precision Pen Super Glue dispensers, manufactured by Henkel Corporation were purchased at retail (identified in the Table as "Loctite®"). For the tests, adhesive was dispensed by squeezing with both hands until no more adhesive came out of the devices. The amounts of dispensed adhesive were then weighed. The total fill weight of each of the tubes was determined by removing the adhesive-containing tubes from the respective dispensing tools, further squeezing each tube by hand, followed by squeezing each tube with pliers, including tube neck deformation, to dispense any remaining adhesive. Those amounts were also measured and added to the previous dispensed amounts to arrive at values for total fill weights. The results are reported in Table 1 below.

TABLE 1

| Sample | Device | Dispenced Product (g) | Total Product Weight (g) | % Evacuation | Mean Dispensed | Standard Deviation Dispensed |
|---|---|---|---|---|---|---|
| 1 | Ex. | 5.62 | 5.65 | 99% | 96.6% | 0.019 |
| 2 | Ex. | 5.61 | 5.86 | 96% | | |
| 3 | Ex. | 5.41 | 5.75 | 94% | | |
| 4 | Ex. | 5.56 | 5.63 | 99% | | |
| 5 | Ex. | 5.49 | 5.70 | 96% | | |
| 6 | Ex. | 5.53 | 5.64 | 98% | | |
| 7 | Ex. | 5.58 | 5.86 | 95% | | |
| 8 | Ex. | 5.59 | 5.70 | 98% | | |
| 9 | Ex. | 5.34 | 5.67 | 94% | | |
| 10 | Ex. | 5.48 | 5.73 | 96% | | |
| 11 | Loctite ® | 3.06 | 3.66 | 84% | 81.2% | 0.017 |
| 12 | Loctite ® | 3.08 | 3.71 | 83% | | |
| 13 | Loctite ® | 2.92 | 3.63 | 80% | | |
| 14 | Loctite ® | 3.09 | 3.75 | 82% | | |
| 15 | Loctite ® | 3.11 | 3.78 | 82% | | |
| 16 | Loctite ® | 3.03 | 3.68 | 82% | | |
| 17 | Loctite ® | 3.03 | 3.77 | 80% | | |
| 18 | Loctite ® | 2.92 | 3.64 | 80% | | |
| 19 | Loctite ® | 2.95 | 3.74 | 79% | | |
| 20 | Loctite ® | 2.98 | 3.78 | 79% | | |

As can be seen in Table 1 above, significantly more product was dispensed using a device for dispensing material according to embodiments disclosed and described herein It is noted that terms like "preferably," "commonly," and "typically" are not utilized herein to limit the scope of embodiments or to imply that certain features are critical, essential, or even important to the structure or function of embodiments. Rather, these terms are merely intended to highlight alternative or additional features that may or may not be utilized in a particular embodiment.

For the purposes of describing and defining embodiments it is noted that the terms "substantially" and "approximately" are utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

It will be apparent to those skilled in the art that various modifications and variations can be made to the embodiments described herein without departing from the spirit and scope of the claimed subject matter. Thus, it is intended that the specification cover the modifications and variations of the various embodiments described herein provided such modification and variations come within the scope of the appended claims and their equivalents.

What is claimed is:

1. A device for dispensing a material comprising:

a first surface comprising an orifice;

a second surface opposite the first surface;

a first endface comprising an annular opening;

a second endface opposite the first endface;

a cavity defined by the first surface, the second surface, the first endface, and the second endface; and an actuator anchored to the second surface and comprising a pressing pad, wherein at least a portion of the pressing pad extends through the orifice in the first surface, wherein the second surface comprises an outer side that faces outward from the device and an inner side that faces inward to the cavity, and the inner side of the second surface comprises a contoured portion within the cavity, the contoured portion having a first end positioned toward the second endface and a second end positioned toward the first endface, wherein the contoured portion has a convex segment near the first end, and a concave segment between the first end and the second end.

2. The device according to claim 1, wherein the second surface is a rigid surface without any orifices.

3. The device according to claim 1, wherein the contoured portion is configured to contact a tube of material and contoured to match a shape of the tube of material.

4. The device according to claim 3, wherein the contoured portion is positioned within the cavity so that when a tube of liquid material is placed in the cavity, a reservoir of the tube is positioned between the second end of the contoured portion and the annular opening of the first endface.

5. The device according to claim 1, wherein a distance between the annular opening in the first endface and the second end of the contoured portion is from 55% to 75% of the diameter of the annular opening.

6. The device according to claim 1, wherein a distance between the annular opening in the first endface and the second end of the contoured portion is from 0.310 inches to 0.380 inches.

7. The device according to claim 1, wherein an end of the orifice closest to the first endface is aligned across the cavity from the second end of the contoured portion.

8. The device according to claim 1, wherein the actuator comprises a planar contact surface opposite the pressing pad and an angled surface that is configured to contact a tube of material and that is adjacent to the planar contact surface, the angled surface being positioned toward the first endface of the device from the planar contact surface.

9. The device according to claim 8, wherein an angle θ is present between the planar contact surface and the angled surface.

10. The device according to claim 9, wherein the angle θ is from 160° to 170°.

11. The device according to claim 10, wherein, when pressure is applied to the pressing pad of the actuator, the intersection of the planar contact surface and the angled surface is opposite the second end of the contoured portion.

12. The device according to claim 11, wherein when pressure is applied to the pressing pad of the actuator, a distance between the annular opening in the first endface and the intersection of the planar contact surface and the angled surface is from 55% to 75% of the diameter of the annular opening.

13. The device according to claim 11, wherein when pressure is applied to the pressing pad of the actuator, a distance between the annular opening in the first endface and the intersection of the planar contact surface and the angled surface is from 0.310 inches to 0.380 inches.

14. A system for dispensing a material from a tube comprising:

a first surface comprising an orifice;

a second surface opposite the first surface;

a first endface comprising an annular opening;

a second endface opposite the first endface;

a cavity defined by the first surface, the second surface, the first endface, and the second endface;

a tube containing the material positioned within the cavity;

a nozzle detachably attached to the tube and protruding from the cavity through the annular opening in the first endface;

an actuator anchored to the second surface and comprising a pressing pad, wherein at least a portion of the pressing pad extends through the orifice in the first surface, wherein the second surface comprises an outer side that faces outward from the device and an inner side that faces inward to the cavity, and the inner side of the second surface comprises a contoured portion within the cavity, the contoured portion having a shape that replicates concave segment and a convex segment that the shape of the tube of material.

15. The system of claim 14, wherein the tube of material comprises a shoulder, and the shoulder is positioned between the second end of the contoured portion and the annular opening of the first endface.

16. The system of claim 15, wherein the actuator comprises a planar contact surface opposite the pressing pad and an angled surface adjacent to the planar contact surface, the angled surface being positioned toward the shoulder of the tube containing the material.

17. The system of claim 16, wherein applying pressure to the pressing pad of the actuator causes the planar contact surface to move toward the tube containing the material, thereby dispensing material through the nozzle.

18. The system of claim 15, wherein a distance between the annular opening in the first endface and the second end of the contoured portion is from 55% to 75% of the diameter of the shoulder.

19. The system of claim 16, wherein when material is fully dispensed from the tube, a reservoir is present in the tube, the reservoir is positioned between the second end of the contoured portion and the annular opening of the first endface.

20. The system of claim 19, wherein when material is fully dispensed from the tube and pressure is applied to the pressing pad of the actuator, the reservoir is positioned between an intersection of the planar contact surface and the angled surface of the actuator and annular opening of the first endface.

* * * * *